United States Patent [19]

Shiozaki et al.

[11] Patent Number: 4,950,575

[45] Date of Patent: Aug. 21, 1990

[54] TONER FOR DEVELOPING ELECTROPHOTOGRAPHIC IMAGES AND PROCESS FOR PREPARATION THEREOF

[75] Inventors: Masaya Shiozaki, Kyoto; Nobuhiro Hirano, Osaka, both of Japan

[73] Assignee: Mita Industrial Co., Ltd., Osaka, Japan

[21] Appl. No.: 313,851

[22] Filed: Feb. 23, 1989

[30] Foreign Application Priority Data

Feb. 26, 1988 [JP] Japan ..... 63-44686

[51] Int. Cl.[5] ..... G03G 9/08

[52] U.S. Cl. ..... 430/110; 430/904

[58] Field of Search ..... 430/109, 110, 904

[56] References Cited

U.S. PATENT DOCUMENTS 3,928,656 12/1975 Strella ..... 430/109 X
4,071,655 1/1978 Brana ..... 430/104 X
4,448,871 5/1984 Tomaki ..... 430/137 X

FOREIGN PATENT DOCUMENTS 1174573 1/1969 United Kingdom ..... 430/110

*Primary Examiner*—J. David Welsh
*Attorney, Agent, or Firm*—H. Jay Spiegel

[57] ABSTRACT

Disclosed is a toner for developing statically charged images, which has a substantially spherical shape and comprises a copolymer comprising, as a constituent, a water-soluble monomer having a group—$SO_3X$ in which X stands for hydrogen, sodium, potassium or calcium.

This toner has a good charge characteristics, an excellent flowability and a uniform particle size. If this toner is used, fogging is not caused in a copied image, and the obtained image is sharp and has an excellent resolving power.

This toner is prepared by a process for the preparation of a toner for developing statically charged images, which comprises incorporating a copolymer comprising a water-soluble monomer having a group—$SO_3X$ in which X stands for hydrogen, sodium, potassium or calcium and an oil-soluble monomer into a polymerizable composition comprising a polymerizable monomer, an initiator and a colorant, and suspension-polymerizing the composition.

10 Claims, No Drawings

TONER FOR DEVELOPING ELECTROPHOTOGRAPHIC IMAGES AND PROCESS FOR PREPARATION THEREOF

BACKGROUND OF THE INVENTION

1. Field of the Invention

The present invention relates to a toner for developing statically charged images and a process for the preparation of this toner.

2. Description of the Related Art

In the field of the electrophotography, a toner is used for visualizing a statically charged image. This toner consists of particles having a particle size arranged within a certain range, for example, a range of from 5 to 30 μm, which are formed of a composition comprising a resin medium, a colorant, a charge-controlling agent and other additive. A resin having desired electroscopic property and binding property, for example, a styrene resin, is used as the resin medium. Carbon black and other organic or inorganic coloring pigments are used as the colorant.

According to a most typical process for the preparation of a toner for the electrophotography, a resin medium as mentioned above is melt-kneaded with a colorant, the melt-kneaded mixture is cooled and pulverized, and the pulverized product is classified to obtain particles having a particle size included within a certain range. However, the yield of the toner obtained through the pulverization and classification steps is very low and large equipments are necessary for these operations. Accordingly, the manufacturing cost of the toner is very high. Moreover, since shapes of the obtained particles are irregular, the flowability of the toner is generally low and blocking is readily caused.

As the means for preparing fine particles of a colored polymer directly without performing the pulverization, there have been proposed polymerization processes as disclosed in Japanese Patent Publications No. 10231/61, No. 14895/76, No. 17735/78, No. 17736/76, No. 17737/78 and No. 51830/72. These processes are so-called suspension polymerization processes. Namely, a polymerizable composition comprising a polymerizable monomer, a polymerization initiator and a colorant is suspended in an aqueous dispersion medium and is polymerized, whereby a toner is directly prepared. This suspension polymerization process is advantageous in that the formed toner particles have a spherical shape and are excellent in the flowability, the preparation process is simple and the manufacturing cost is low.

However, in the case where a charge-controlling agent is incorporated into the polymerizable composition for obtaining a toner having frictional charge characteristics suitable for the development in the production of a toner by the suspension polymerization, since the charge-controlling agent is hardly distributed on the surfaces of particles of suspended oil drops but are buried in the interior of the particles, in order to obtain a toner having a satisfactory charge quantity, a considerable amount of the charge-controlling agent should be incorporated in the polymerizable composition. However, most of charge-controlling agents exhibit a polymerization-inhibiting action because of the presence of polar groups in the charge-controlling agents, and therefore, the molecular weight of the obtained polymer is low or the polymerization reaction is not completed. Accordingly, the amount used of the charge-controlling agent is limited and a toner satisfactory in the charge characteristics and binding property cannot be obtained.

As the means for overcoming the above-mentioned disadvantage, Japanese Patent Application Laid-Open Specification No. 144836/83 proposes a process for the preparation of a toner, in which a copolymer comprising, as a constituent, a monomer having a polar group, such as acrylonitrile, is incoporated into a polymerizable composition and the suspension polymerization of the polymerizable composition is carried out. In this process, however, in order to obtain a toner having a satisfactory charge quantity, a large quantity of the copolymer should be incorporated into the polymerizable composition, and with increase of the amount incorporated of the copolymer, the viscosity of the polymerizable composition increases, and the oil drop particles come to show a broad particle size distribution when suspended oil drops are formed. Therefore, in the formed toner, a toner particle size applicable to the practical use is not obtained and hence, the classification step becomes necessary, with the result that the process steps become complicated.

SUMMARY OF THE INVENTION

It is therefore a primary object of the present invention to solve the above-mentioned problems involved in the conventional toners for developing statically charged images and provide a toner which is excellent in the charge-controlling action, the flowability and the uniformity of the particle size.

Another object of the present invention is to provide a process in which a toner showing a stable charge-controlling action and having a sharp particle size distribution can be prepared at a high efficiency while using a copolymer comprising a monomer having a polar group as a constituent in an amount much smaller than in the conventional process without substantial broadening of the particle size distribution of oil drop particles caused by increase of the viscosity of the polymerizable composition.

The foregoing objects of the present invention are attained by incorporating a copolymer comprising a water-soluble monomer having a group $-SO_3X$ in which X stands for hydrogen, sodium, potassium or calcium and an oil-soluble monomer into a polymerizable composition comprising a polymerizable monomer, an initiator and a colorant, and suspension-polymerizing the composition to form a toner having a substantially spherical shape.

More specifically, in accordance with one aspect of the present invention, there is provided a toner for developing statically charged images, which has a substantially spherical shape and comprises a copolymer comprising, as a constituent, a water-soluble monomer having a group $-SO_3X$ in which X stands for hydrogen, sodium potassium or calcium.

In accordance with another aspect of the present invention, there is provided a process for the preparation of a toner for developing statically charged images, which comprises incorporating a copolymer comprising a water-soluble monomer having a group $-SO_3X$ in which X stands for hydrogen, sodium, potassium or calcium and an oil-soluble monomer into a polymerizable composition comprising a polymerizable monomer, an initiator and a colorant, and suspension-polymerizing the composition.

DETAILED DESCRIPTION OF THE PREFERRED EMBODIMENTS

The present invention is based on the finding that if a copolymer comprising, as a constituent, a monomer having sulfonic acid or a sulfonic acid salt as the polar group is used, a toner which is excellent in the charge characteristics such as the rising of the charge quantity and the charge stability and has a sharp particle size distribution can be obtained in a high yield even if the amount incorporated of the copolymer is so small as not causing substantial increase of the viscosity of the polymerizable composition.

In the copolymer used in the present invention, one monomer is a monomer having a group $—SO_3X$ in which X stands for hydrogen, sodium, potassium or calcium, and this monomer has a high polarity and a high water solubility. The other monomer is an oil-soluble, polymerizable monomer. Accordingly, if this copolymer comprising these monomers as constituents is incorporated in the polymerizable composition and oil particles are formed by the suspension polymerization of the polymerizable composition, by dint of the water-soluble sulfonic acid or sulfonic acid salt group, the copolymer is distributed in the vicinity of the interface between the surfaces of the oil drop particles and the dispersion medium (aqueous phase) without elution of the copolymer, and a toner is formed while maintaining this state. Accordingly, because of the strong polarity of the sulfonic acid or sulfonic acid salt, the toner can be effectively charged negatively and the amount used of the copolymer can be reduced to such a low level as not causing increase of the viscosity of the polymerizable composition.

As the monomer having a group $—SO_3X$ in which X stands for hydrogen, sodium, potassium or calcium, that is used in the present invention, there can be mentioned styrene-sulfonic acid, vinylsulfonic acid, acrylamidemethylpropane-sulfonic acid and methane-sulfonic acid, and sodium, potassium and calcium salts of these sulfonic acids. In view of the charge-controlling property and reactivity, styrene-sulfonic acid is especially preferred.

As the oil-soluble monomer for forming the copolymer together with the above-mentioned monomer, any of oil-soluble monomers ordinarily used for binder resins of toners can be used, and a styrene type monomer is preferred. In connection with the copolymer, it is preferred that the polar group-containing monomer be contained in an amount of 0.2 to 50% by weight, especially 10 to 30% by weight, in the copolymer.

If the content of the polar group-containing monomer eceeds 50% by weight, the copolymer component is separated from the suspended particles at the suspension polymerization and independently forms fine particles. If the content of the polar group-containing monomer is lower than 0.2% by weight, the copolymer is not present on the surfaces of oil drop particles but is retained in the interior of the particles, and no satisfactory charge-controlling action can be obtained.

Furthermore, the contribution of the copolymer to the improvement of charge characteristics depends on not only the composition of the copolymer but also the content of the polar group-containing monomer based on the total toner, and it is preferred that the content of the polar group-containing monomer based on the total toner be 0.05 to 5% by weight, especially 0.1 to 2% by weight. If this content is lower than 0.05% by weight, the charge-imparting effect is insufficient, and if the content exceeds 5% by weight, abnormal increase of the charge quantity is often caused.

In general, in the case where it is intended to obtain oil drop particles by incorporating, suspending and dispersing a polymerizable composition having a high polarity into an aqueous phase, the interfacial energy between the composition and water having a high polarity is small and a function of increasing the interfacial area is manifested, and therefore, the particle size of oil drop particles becomes small, it is difficult to obtain oil drop particles having a size suitable for a toner and the stability of the suspended oil drop particles tends to lower. In order to obtain particles having a size suitable for a toner by using a water-soluble polymer such as PVA or a surface active agent as the dispersion stabilizer, the amount used of the dispersion stabilizer is limited and the stirring speed should be maintained at a low level, with the result that agglomeration of oil drop particles or broadening of the particle size distribution is readily caused.

In the present invention, if a fine powder of a hardly water-soluble inorganic salt is used as the dispersion stabilizer, the restriction of the stirring speed imposed when a water-soluble polymer or surface active agent is used is eliminated, and therefore, oil drop particles having a size suitable for a toner can be easily obtained and good results ean be obtained.

Furthermore, if the fine powder of the hardly water-soluble inorganic salt is once dissolved in the aqueous phase by adding an acid or alkali to the aqueous phase where the fine powder of the hardly water-soluble inorganic salt is present and the inorganic salt is then precipitated in the form of particles having a very fine particle size by addition of an alkali or acid, fine division of the oil drop particles can be effectively prevented and the oil drop particles can be stabilized with a particle size suitable for a toner.

This effect attained by precipitating the fine powder of the hardly water-soluble inorganic salt in the form of the above-mentioned particles having a very fine particle size is quite different from the effect of stabilizing oil drop particles, which is attained by making a stabilizer such as the above-mentioned water-soluble polymer or surface active agent present in both of the aqueous phase and the oil drop particles. Namely, the fine powder of the inorganic salt is independently present in the interface between the aqueous phase and the oil drop particles, and the fine powder of the inorganic salt stabilizes the oil drop particles in the state where the fine powder of the inorganic salt covers the oil drop particles. Accordingly, the influence of reduction of the interfacial energy between the aqueous phase and the oil drop particles can be moderated and fine division of the oil drop particles can be prevented. By the above-mentioned operation, the fine powder of the hardly water-soluble inorganic powder is precipitated in the form of particles having a size smaller than 0.3 $\mu$m, preferably smaller than 0.1 $\mu$m.

The copolymer to be incorporated into the polymerizable composition in the present invention will now be described.

As the polymerizable monomer having a sulfonic acid group or its salt, which is used in the present invention, there can be mentioned styrene-sulfonic acid, 2-acrylamido-2-methylpropane-sulfonic acid, vinylsulfonic acid and methacrylsulfonic acid, and sodium, potassium and calcium salts of these sulfonic acids.

The oil-soluble polymer for forming a copolymer together with the above-mentioned monomer is a radical-polymerizable monomer, and an appropriate monomer is selected according to the intended fixing property and charge characteristics of the toner. As the radical-polymerizable monomer, there can be mentioned a vinyl monomer, an acrylic monomer, a vinyl ester monomer, a vinyl ether monomer, a diolefin monomer and a mono-olefin monomer.

The copolymer of the present invention is prepared from the monomer having a sulfonic acid or sulfonic acid salt and the oil-soluble radical-polymerizable monomer by bulk polymerization, solution polymerization, emulsion polymerization or suspension polymerization. In view of the control of the polymerization reaction and the easiness of the polymerization operation, it is preferred that the copolymer be prepared by solution polymerization.

The copolymer is added in an amount of 0.1 to 10% by weight based on the entire toner. If the content of the copolymer exceeds 10% by weight, broadening of the particle size distribution is readily caused at the time of formation of oil drops.

The monomer constituting the binder resin is a monomer capable of providing a thermoplastic resin having good binding property and charge characteristics. For example, there can be mentioned a vinyl aromatic monomer, an acrylic monomer, a vinyl ester monomer, a vinyl ether monomer, a diolefin monomer and a mono-olefin monomer.

As the vinyl aromatic monomer, there can be mentioned vinyl aromatic hydrocarbons represented by the following formula:

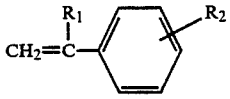

(1)

wherein $R_1$ stands for a hydrogen atom, a lower alkyl group or a halogen atom, and $R_2$ stands for a hydrogen atom, a lower alkyl group, a halogen atom, an alkoxy group, a nitro group or vinyl group, such as styrene, α-methylstyrene, vinyltoluene, α-chlorostyrene, o-chlorostyrene, m-chlorostyrene, p-chlorostyrene, p-ethylstyrene and divinylbenzene. These monomers can be used singly or in the form of a mixture of two or more of them.

Other monomers that can be used for the production of binder resins are described below.

There can be mentioned acrylic monomers represented by the following formula:

$$CH_2{=}\overset{\overset{R_3}{|}}{C}{-}CO{-}O{-}R_4 \qquad (2)$$

wherein $R_3$ stands for a hydrogen atom or a lower alkyl group, and $R_4$ stands for a hydrogen atom, a hydrocarbon group having 12 carbon atoms, a hydroxyalkyl group or a vinyl ester group, such as methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl σ-hydroxyacrylate, ethyl βhydroxymethacrylate, ethylene glycol dimethacrylate and tetraethylene glycol dimethacrylate.

As the vinyl ester, there can be mentioned monomers represented by the following formula:

$$CH_2{=}\underset{\underset{O}{\|}}{\overset{\overset{O}{|}}{CH}}{-}C{-}R_5 \qquad (3)$$

wherein $R_5$ stands for a hydrogen atom or a lower alkyl group, such as vinyl formate, vinyl acetate and vinyl propionate.

As the vinyl ether, there can be mentioned monomers represented by the following formula:

$$CH_2{=}\overset{\overset{O{-}R_6}{|}}{CH} \qquad (4)$$

wherein $R_6$ stands for a monovalent hydrocarbon group having up to 12 carbon atoms, such as vinyl-n-butyl ether, vinylphenyl ether and vinylcyclohexanyl ether.

As the diolefin, there can be mentioned monomers represented by the following formula:

$$CH_2{=}\overset{\overset{R_7}{|}}{C}{-}\overset{\overset{R_8}{|}}{C}{=}CH{-}R_9 \qquad (5)$$

wherein $R_7$, $R_8$ and $R_9$ independently stand for a hydrogen atom, a lower alkyl group or a halogen atom, such as butadiene, isoprene and chloroprene.

As the mono-olefin, there can be mentioned monomers represented by the following formula:

$$CH_2{=}\overset{\overset{R_{10}}{|}}{C}{-}R_{11} \qquad (6)$$

wherein $R_{10}$ and $R_{11}$ independently stand for a hydrogen atom or a lower alkyl group, such as ethylene, propylene, isobutylene, butene-1, pentene-1 and 4-methylpentene-1.

A styrene monomer and an acrylic monomer are especially preferred.

The following pigments and dyes (hereinafter referred to as "coloring pigments") are incorporated as the colorant into the above-mentioned monomers.

Black Pigments

Carbon black, acetylene black, lamp black and aniline black

Yellow Pigments

Chrome yellow, zinc yellow, cadmium yellow, yellow iron oxide, Mineral Fast Yellow, nickel titanium yellow, Teftol Yellow S, Hansa Yellow 10G, Benzidine Yellow G, Quinoline Yellow Lake, Permanent Yellow HGG and Tartrazine Lake Orange Pigments Chrome orange, molybdenum orange, Permanent Orange GTR, Pyrazolone Orange, Vulcan Orange, Indanthrene Brilliant Orange RK, Benzidine Orange G and Indanthrene Brilliant Orange GK Red Pigments Red iron oxide, cadmium red, red lead, mercury cadmium sulfide, Permanent Orange 4R, Lithol Red, Pyrazolone Red, Watchung Red calcium salt, Lake Red D, Brilliant Carmine 6B, Eosine Lake, Rhodamine Lake B, Alizarin Lake and Brilliant Carmine 3B Violet Pigments Manganese red, Fast Violet B, Methyl Violet Lake Blue Pigments Prussian blue, cobalt blue, Alkali Blue Lake, Victorian Blue Lake, Phthalocyanine Blue, metal-free Phthalcyanine Blue, partially chlorinated Phthalocyanine Blue, Fast Sky Blue and Indanthrene Blue BC Green Pigments Chrome green, chromium oxide, Pigment Green B, Marachite Green Lake and Fanal Yellow Green G White Pigments Zinc flower, titanium oxide, antimony white and zinc sulfide Extender Pigments Baryte powder, barium carbonate, clay, silica, white carbon, talc and aluminum white As the magnetic pigment, there are known, for example, triiron tetraoxide ($Fe_3O_4$), diiron trioxide ($\gamma$-$FE_2O_3$), iron zinc oxide ($ZnFe_2O_4$), iron yttrium oxide ($Y_3Fe_5O_{12}$), iron cadmium oxide ($Cd_3Fe_5O_{12}$), iron copper oxide ($CuFe_2O_4$), iron lead oxide ($PbFe_{12}O_{19}$), iron neodium oxide ($NdFeO_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), iron powder (Fe), cobalt powder (Co) and nickel powder (Ni). Fine powders of these magnetic materials can be used in the present invention.

The ratio between the monomer and colorant can be changed in a broad range, and in general, the colorant and monomer can be used at a weight ratio of from 1/100 to 20/100, especially from 3/100 to 10/100.

In the present invention, as the dispersion stabilizer for stabilizing oil drop particles formed by suspending the polymerizable composition comprising the above-mentioned copolymer, the binder resin-forming monomer and the colorant in an aqueous medium, there can be used water-soluble polymers such as polyvinyl alcohol and methyl cellulose, and nonionic and ionic surface active agents. However, use of a fine powder of a hardly water-soluble inorganic salt is preferred because fine division of oil drop particles can be controlled while the stirring speed or the amount used is not restricted. As the fine powder of the hardly water-insoluble inorganic salt, there can be used fine powders of calcium sulfate, calcium phosphate, magnesium carbonate, barium carbonate, calcium carbonate and aluminum hydroxide.

It is preferred that the above-mentioned dispersion stabilizer be added in an amount of 1 to 50% by weight, especially 10 to 25% by weight, based on water. Furthermore, it is preferred that the particle size of the suspended oil drops be adjusted to 5 to 30 $\mu$m, especially 8 to 12 $\mu$m.

As the polymerization initiator, there can be used oil-soluble initiators, for example, azo compounds such as azobisisobutyronitrile and peroxides such as cumene hydroperoxide, t-butyl hydroperoxide, dicumyl peroxide, di-t-butyl peroxide, benzoyl peroxide and lauroyl peroxide. Furthermore, ionizing radiations such as $\gamma$-rays and accelerated electron beams, and various sensitizers, can be used in combination with the initiator.

The polymerization initiator such as the azo compound or peroxide can be incorporated in a so-called catalytic amount, and it is preferred that the polymerization initiator be used in an amount of 0.1 to 10% by weight based on the charged monomer.

known polymerization initiation temperature and polymerization time can be adopted. However, it is generally sufficient if the polymerization is carried out at 40 to 100° C. for 1 to 50 hours. Furthermore, such gentle stirring as causing homogeneous reaction as a whole is sufficient as the stirring of the reaction mixture. In order to prevent inhibition of the polymerization by oxygen, the polymerization can be carried out by replacing the atmosphere of the reaction system by an inert gas such as nitrogen.

The obtained polymerization product has a particle size included within the above-mentioned range, and the polymerization product is obtained in the form of spherical particles in the state where the charge-controlling polar group is present on the surfaces of the particles. The formed particles are recovered by filtration, and if necessary, the particles are washed with water or an appropriate solvent and dried, whereby colored particles for a toner are obtained.

If necessary, the colored particles for a toner are sprinkled with carbon black or hydrophobic silica, whereby a final toner is obtained.

In the present invention, additives to be preferably added to the toner can be incorporated into the polymerizable composition prior to initiation of the polymerization. For example, in order to supply a rising charge and improve the environmental stability, a known charge-controlling agent can be incorporated in such a small amount as not influencing the polymerization reaction. Furthermore, a release agent such as low-molecular-weight polyethylene, low-molecular-weight polypropylene, a wax or a silicone oil can be added as the offset-preventing agent.

The present invention will now be described in detail with reference to the following examples that by no means limit the scope of the invention.

SYNTHESIS EXAMPLE 1

A copolymer-forming composition comprising 10 parts by weight of sodium styrene-sulfonate, 90 parts by weight of styrene, 20 parts by weight of AIBN (polymerization initiator), 240 parts by weight of water and 720 parts by weight of isopropyl alcohol was prepared, and polymerization was carried out at 80° C. in a nitrogen atmosphere according to a customary solution polymerization process to obtain a copolymer precipitated in the solvent. The obtained polymer was recovered by decantation and washed with isopropyl alcohol to remove water, and the remaining polymer was dried under reduced pressure to obtain a powdery copolymer having a weight average molecular weight of 2400. This copolymer is designated as "copolymer A".

SYNTHESIS EXAMPLE 2

A powdery copolymer having a weight average molecular weight of 2600 was prepared in the same manner as described in Synthesis Example 1 except that the amount of sodium styrene-sulfonate was changed to 40 parts by weight. This copolymer is designated as "copolymer B".

SYNTHESIS EXAMPLE 3

A powdery copolymer having a number average molecular weight of 2300 was prepared in the same manner as described in Synthesis Example 1 except that the amount of sodium styrene-sulfonate was charged to 0.5 part by weight and the amount of styrene was changed to 99.5 parts by weight. This copolymer is designated as "copolymer C".

SYNTHESIS EXAMPLE 4

A powdery copolymer having a number average molecular weight of 2500 was prepared in the same manner as described in Synthesis Example 1 except that the amount of sodium styrene-sulfonate was changed 50 parts by weight and the amount of styrene was changed to 50 parts by weight. This copolymer is designated as "copolymer D".

SYNTHESIS EXAMPLE 5

A powdery copolymer having a number average molecular weight of 2300 was prepared in the same manner as described in Synthesis Example 1 except that amount of sodium styrene-sulfonate was changed to 0.1 part by weight and the amount of styrene was changed to 99.9 parts by weight. This copolymer is designated as "copolymer E".

SYNTHESIS EXAMPLE 6

A copolymer-forming composition comprising 20 parts by weight of acrylonitrile, 80 parts by weight of styrene, 20 parts by weight of AIBN (polymerization initiator) and 800 parts by weight of methyl alcohol was prepared, and polymerization was carried out at 80° C. in a nitrogen atmosphere according to a customary solution polymerization process to obtain a copolymer precipitated in the solvent. The obtained polymer was recovered by decantation and washed with isopropyl alcohol to remove water. The remaining copolymer was dried under reduced pressure to obtain a powdery copolymer having a weight average molecular weight of 4500. This copolymer is designated as "copolymer F".

EXAMPLE 1

A polymerizable composition comprising 64 parts by weight of styrene, 30 parts by weight of n-butyl methacrylate, 6 parts by weight of the copolymer A, 0.5 parts by weight of a charge-controlling agent (Bontron S-36 supplied by Orient Chemical), 5 parts by weight of grafted carbon black, 1.5 parts by weight of low-molecular-weight polypropylene and 4 parts by weight of low-molecular-weight polypropylene and 4 parts by weight of AIBN (polymerization initiator) was thrown into a dispersion medium comprising 400 parts by weight of water, 15 parts by weight of tricalcium phosphate and 0.01 parts by weight of sodium dodecylbenzene-sulfonate, and the polymerizable composition was suspended and dispersed in the aqueous medium by using a TK homomixer (supplied by Tokushu Kika Kogyo). Normal stirring was carried out at 80° C. in a nitrogen atmosphere and polymerization was carried out for 5 hours to obtain a suspension containing polymer particles. The particles were washed with hydrochloric acid to remove the adhering residual tricalcium phosphate by dissolution, and the particles were washed with water, filtered and dried to obtain a spherical toner. When the particle size distribution was measured by a Coulter counter, it was found that the volume average particle size was 10.8 μm and the content of fine particles having a size smaller than 5 μm was 0.2%.

When the circularity of the toner was measured, it was found that the toner was composed of spherical particles having a high circularity. Incidentally, the circularity D is determined according to the following formula:

$$D = \frac{\sqrt{rl \cdot rs}}{rl}$$

wherein rl stands for a long diameter of the toner particles and rs stands for a short diameter of the toner particles.

The toner was mixed with a ferrite carrier and frictionally charged, and the charge quantity was measured according to the blow-off method. It was found that the charge quantity was 32.0 μc/g. In order to examine the charge quantity distribution of the toner, an air current was introduced at a speed of 950 mm/sec between parallel electrodes having a width of 70 mm. which were perpendicularly arranged with a gap of 5 mm, and the above-mentioned developer was let to fall down between the electrodes. The toner adhered only to the positive electrode but did not adhere to the negative electrode at all. Accordingly, it was found that positively charged toner particles were not substantially present. Furthermore, 8 g of the obtained toner and 192 g of the ferrite carrier were charged in a cylindrical polyethylene vessel having a capacity of 200 cc and they were mixed. The time required for obtaining a saturated charge quantity was as short as 10 seconds.

When the above-mentioned developer was subjected to the copying test using an electrophotographic copying machine (Model DC-1001 supplied by Mita Industrial Co.), it was found that fogging was not caused in the obtained images, fine lines could be reproduced in good conditions and scattering of the toner in the copying machine was not caused.

EXAMPLE 2

A spherical toner was synthesized in the same manner as described in Example 1 except that 12 parts by weight of the copolymer C was used instead of the copolymer A, styrene was used in an amount of 58 parts by weight and the content of the polar group-containing monomer was 0.05% by weight based on the toner. The obtained toner was tested in the same manner as described in Example 1. It was found that the toner was composed of spherical particles having a circularity of 0.92, the volume average particle size was 10.2 μm and the content of finer toner particles was 0.1%. The toner charge quantity was 34.5 μc/g, toner particles having the reverse polarity were not substantially present and the charge characteristics were good. Furthermore, the rising time required for obtaining a saturation charge quantity was 8 seconds. At the copying test, good results were similarly obtained.

EXAMPLE 3

A spherical toner was synthesized in the same manner as described in Example 1 except that 10 parts by weight of the copolymer D was used instead of the copolymer A, 60 parts by weight of styrene was used and the content of the polar group-containing monomer was 4.5% by weight based on the toner. The toner was tested in the same manner as described in Example 1. It was found that the toner was composed of spherical particles having a circularity of 0.93, the volume average diameter was 9.9 μm and the content of finer particles was 0.1%. The charge quantity of the toner was 35.2 μC/g, toner particles having the reverse polarity were not substantially present and the charge characteristics were good. The rising time required for obtaining a saturation charge quantity was 8 seconds. At the copying test, good results were similarly obtained.

EXAMPLE 4

To 400 parts by weight of distilled water were added 5.5 parts of tricalcium phosphate and 0.01 part by weight of sodium dodecylbenzene-sulfonate, and hydrochloric acid was added to this dispersion medium to dissolve tricalcium phosphate. Then, sodium hydroxide was added with stirring to the dispersion medium to precipitate the dissolved tricalcium phosphate in the dispersion medium. When the precipitate was obtained by an electron microscope, it was found that the particle size of the precipitate was smaller than 0.3 μm.

The same polymerizable composition was used in Example 1 was thrown in the so-obtained dispersion medium and the mixture was stirred at 8000 rpm for 15 minutes by a TK homomixer (supplied by Tokushu Kika Kogyo), whereby oil drop particles having a uniform particle size were uniformly dispersed. This suspension was transferred into a separable flask, and polymerization was carried out at 80 rpm and 70° C. for 5 hours in a nitrogen atmosphere. After completion of the polymerization reaction, the polymer was recovered by filtration, treated with a dilute acid, washed with water and dried to obtain a toner composed of spherical particles having a circularity of 0.94.

When the particle size distribution was measured by a Coulter counter, it was found that the average particle size was 11.1 μm, the content of finer particles having a particle size smaller than 8 μm was 1.9%, and the particle size distribution was very sharp.

When the charge quantity was measured by the blow-off method, it was found that the charge quantity was 33.0 μC/g. The obtained toner was mixed with a ferrite carrier and the toner concentration was adjusted to 45%, and the copying test was carried out by using an electrophotographic copying machine (Model DV-2055 supplied by Mita Industrial Co.). Fogging was not caused, fine lines were reproduced in good conditions, the resolving power was more than 5 lines per mm, and a sharp copied image was obtained. Furthermore, scattering of the toner was not caused in the copying machine.

COMPARATIVE EXAMPLE 1

A toner was synthesized in the same manner as described in Example 1 except that 5 parts of the copolymer B was used instead of the copolymer A and the amount of styrene was charged to 65 parts by weight. The copolymer component was separated from polymer particles during the polymerization to form ultrafine particles anew, and therefore, the intended toner particles could not be obtained.

COMPARATIVE EXAMPLE 2

A toner was prepared in the same manner as described in Example 1 except that 20 parts of the copolymer E was used instead of the copolymer A and the amount of styrene was charged to 50 parts. The volume average particle size was 10.5 μm and the content of finer particle sizes was 0.3%. However, the charge quantity of the toner was −10.0 μC/g and the presence of a small amount of particles having a reverse polarity was confirmed. At the copying test, fogging was observed in the obtained image and the obtained image was obscure.

EXAMPLE 3

A toner was synthesized in the same manner as described in Example 1 except the amount of the copolymer A was changed to 0.5 part by weight and the amount of styrene was changed to 69.5 parts. The volume average particle size 10.2 μm and the content of finer toner particles was 0.3%. The charge quantity of the toner was −9.8 μC/g and formation of toner particles having a reverse polarity was confirmed. At the copying test, fogging was found in the obtained image, and the obtained image lacked the sharpness.

COMPARATIVE EXAMPLE 4

A toner was synthesized in the same manner as described in Example 1 except that 12 parts by weight of the copolymer D was used instead of the copolymer A and the amount of styrene was changed to 58 parts. As in Comparative Example 1, the copolymer was separated from the polymer particles at the polymerization step to form ultrafine particles anew, and therefore, the intended toner particles could not be obtained. Furthermore, at the copying test, background fogging was observed.

As is apparent from the foregoing description, according to the present invention, a toner having good charge characteristics, an excellent flowability and a uniform particle size. Accordingly, fogging is not caused in a copied image, and the obtained image is sharp and has an excellent resolving power. Moreover, the amount of a charge-controlling, polar group-containing monomer, required for the production, is small. Accordingly, the particle size distribution of obtained polymer particles is sharp, and toner particles having an appropriate particle size can be prepared at a high efficiency.

We claim:

1. A toner for developing electrostatically charged images, which comprises:

(A) a binder resin;

(B) a colorant; and (C) a charge-controlling agent, wherein said charge-controlling agent is a copolymer of an oil-soluble monomer and 0.2 to 50% by weight, based on the copolymer, of a water-soluble monomer having a group $-SO_3X$ in which X stands for hydrogen, sodium, potassium or calcium, and said copolymer is present in such an amount that the content of the water-soluble monomer unit based on the total toner is 0.05 to 5% by weight.

2. A toner as set forth in claim 1, wherein the water-soluble monomer is contained in an amount of 10 to 30% by weight in the copolymer.

3. A toner as set forth in claim 1, wherein said water-soluble monomer is a styrene-sulfonic acid or a sodium, potassium or calcium salt thereof.

4. A toner as set forth in claim 1, wherein the oil-soluble monomer is selected from the group consisting of a vinyl monomer, an acrylic monomer, a vinyl ester monomer, a vinyl ether monomer, a diolefin monomer and a mono-olefin monomer.

5. A toner as set forth in claim 1, wherein said oil-soluble monomer is a styrene monomer.

6. A toner as set forth in claim 1, wherein said copolymer is present in an amount of 0.1 to 10% by weight based on the entire toner.

7. A toner for developing electrostatically charged images, which comprises substantially spherical particles of a toner composition comprising:

(A) a binder resin;

(B) a colorant; and (C) as a charge-controlling agent, a copolymer of an oil-soluble radical-polymerizable monomer and 0.2 to 50% by weight, based on the copolymer, of a water-soluble monomer having a group —$SO_3X$ in which X stands for hydrogen, sodium, potassium or calcium, said copolymer being present in such an amount that the content of the water-soluble monomer based on the total toner is 0.05 to 5% by weight.

8. A process for the preparation of a toner for developing electrostatically charged images, which comprises preparing a copolymer of an oil-soluble monomer and 0.2 to 50% by weight, based on the copolymer, of a water-soluble monomer having a group —$SO_3X$ in which X stands for hydrogen, sodium, potassium or calcium, incorporating said copolymer into a polymerizable composition comprising a polymerizable monomer for formation of a binder resin, an initiator and a colorant, in such an amount that the content of the water-soluble monomer unit of the copolymer based on a toner to be formed is 0.05 to 5% by weight, dispersing said composition with the copolymer into an aqueous medium to form a suspension, and suspension-polymerizing said polymerizable composition to convert the composition with the copolymer to substantially spherical particles.

9. A toner for developing electrostatically charged images, which comprises:

(A) a binder resin;

(B) a colorant; and (C) a charge-controlling agent, wherein said charge-controlling agent is a copolymer of an oil-soluble monomer and a water-soluble monomer having a group —$SO_3X$ in which X stands for hydrogen, sodium, potassium or calcium.

10. A process for the preparation of a toner for developing electrostatically charged images, which comprises preparing a copolymer of an oil-soluble monomer and a water-soluble monomer having a group —$SO_3X$ in which X stands for hydrogen, sodium, potassium or calcium for use as a charge-controlling agent, incorporating said copolymer into a polymerizable composition comprising a polymerizable monomer for formation of a binder resin, an initiator and a colorant, dispersing said composition with the copolymer into an aqueous medium to form a suspension, and suspension-polymerizing said polymerizable composition to convert the composition with the copolymer to substantially spherical particles.

* * * * *